US005690694A

United States Patent [19]

Kang

[11] Patent Number: 5,690,694

[45] Date of Patent: Nov. 25, 1997

[54] SIZING AGENTS FROM INDIGO BLUE DENIM FABRIC

[76] Inventor: Chul Soon Kang, 2721 N. Vista Knoll Rd., Orange, Calif. 92667

[21] Appl. No.: 708,793

[22] Filed: Sep. 9, 1996

[51] Int. Cl.[6] ..... D06L 1/16

[52] U.S. Cl. ..... 8/102; 8/138; 26/25; 26/27; 26/28; 68/27

[58] Field of Search ..... 8/102, 107, 137, 8/138; 68/27; 26/25, 27, 28; 435/263, 264

[56] References Cited

U.S. PATENT DOCUMENTS

| | | | |
|---|---|---|---|
| 4,463,736 | 8/1984 | Cholley | 8/108.1 |
| 4,558,575 | 12/1985 | Serracant et al. | 68/181 R |
| 4,769,879 | 9/1988 | Otto | 26/25 |
| 4,912,056 | 3/1990 | Olson | 435/263 |
| 4,984,438 | 1/1991 | Batty | 68/27 |
| 5,363,599 | 11/1994 | Dischler | 451/326 |

*Primary Examiner*—Alan Diamond
*Attorney, Agent, or Firm*—Erik M. Arnhem

[57] ABSTRACT

A denim fabric sheet is drawn into a folded rope configuration, and passed through an impact mechanism and an abrasion mechanism to give the fabric sheet a worn-out stonewashed appearance. Prior to passage through the impact mechanism the fabric sheet is coated with a water solution containing about five percent lubricant, four percent surfactant and about one percent antimigrant. After passage through the impact mechanism, the fabric sheet is rinsed and coated with a more dilute water solution about one percent lubricant, one quarter percent surfactant, about one half percent migrant, and about one half cellulase enzyme. The process is controllable to produce a consistent product appearance and fabric texture.

5 Claims, 1 Drawing Sheet

SIZING AGENTS FROM INDIGO BLUE DENIM FABRIC

BACKGROUND OF THE INVENTION

This invention relates to a method of removing coloring and sizing agents from indigo blue denim fabric, whereby the fabric has a worn-out appearance and a flexible soft feel to the touch. The method is performed while the fabric is in sheet form, i.e. prior to the garment manufacturing process.

Various methods and apparatus have been devised to give indigo blue denim fabric garments a soft, stone-washed, worn-out appearance. Such methods include mechanical laundering to remove the sizing and some of the dye, chlorine bleach washing, enzyme washing, and stone washing.

U.S. Pat. No. 4,643,736 discloses a method of treating fabric in a heated bath containing sodium chlorite bleach, a starch-degrading enzyme, and a surfactant.

U.S. Pat. No. 4,769,879 discloses a mechanism for mechanically conditioning a sheet of textile fabric material by passing the sheet through a pair of rotating beaters. Each beater comprises one or more flexible flaps adapted to impact one surface of the fabric sheet so as to exert a shear force thereon. The impact forces tend to fracture fiber-to-fiber resin bonding forces, thereby enhancing the softness of the fabric.

U.S. Pat. No. 4,912,056 discloses a method of treating denim fabric with a cellulase enzyme solution, while subjecting the fabric to mechanical action, whereby the fabric has a stonewashed appearance.

U.S. Pat. No. 4,984,438 shows a fabric washing apparatus that comprises a horizontal rotary drum sectioned into a number of separate compartments, whereby fabric garments can be lifted and tumbled in each compartment before being transferred to the next compartment. Different washing and rinsing solutions can be supplied to different compartments.

U.S. Pat. No. 5,363,599 shows a tumble-type washing machine that uses air jets to create a vortex condition that vibrates the fabric materials, to loosen and break fiber bonds in the fabric.

SUMMARY OF THE INVENTION

The present invention concerns a method of removing coloring and sizing agents from indigo blue denim fabric sheet material, whereby the fabric has a soft, faded, worn-out appearance.

The method of this invention is advantageous in that it combines various operations in one apparatus, whereby the fabric is subjected to a series of different treatments during its passage through the apparatus. The method involves treating a travelling fabric sheet with a first water solution containing a non-ionic lubricant, a non-ionic surfactant, and an antimigrant; forming the solution-coated fabric into a longitudinally-folded rope configuration; passing the rope-formed sheet across an impact mechanism to augment the cleaning action of the solution on the fibers, rinsing the rope-formed sheet to remove particulates from the fabric; treating the travelling rope with a second water solution containing an antimigrant, lubricant, surfactant, and cellulase enzyme; passing the fabric rope through an abrasion mechanism to augment the cleaning effect of the second solution; rinsing the fabric rope a second time to remove particulates; and treating the fabric rope with a softener solution to improve the softness of the fabric.

DESCRIPTION OF A PREFERRED EMBODIMENT OF THE INVENTION

Figures 1, 2:
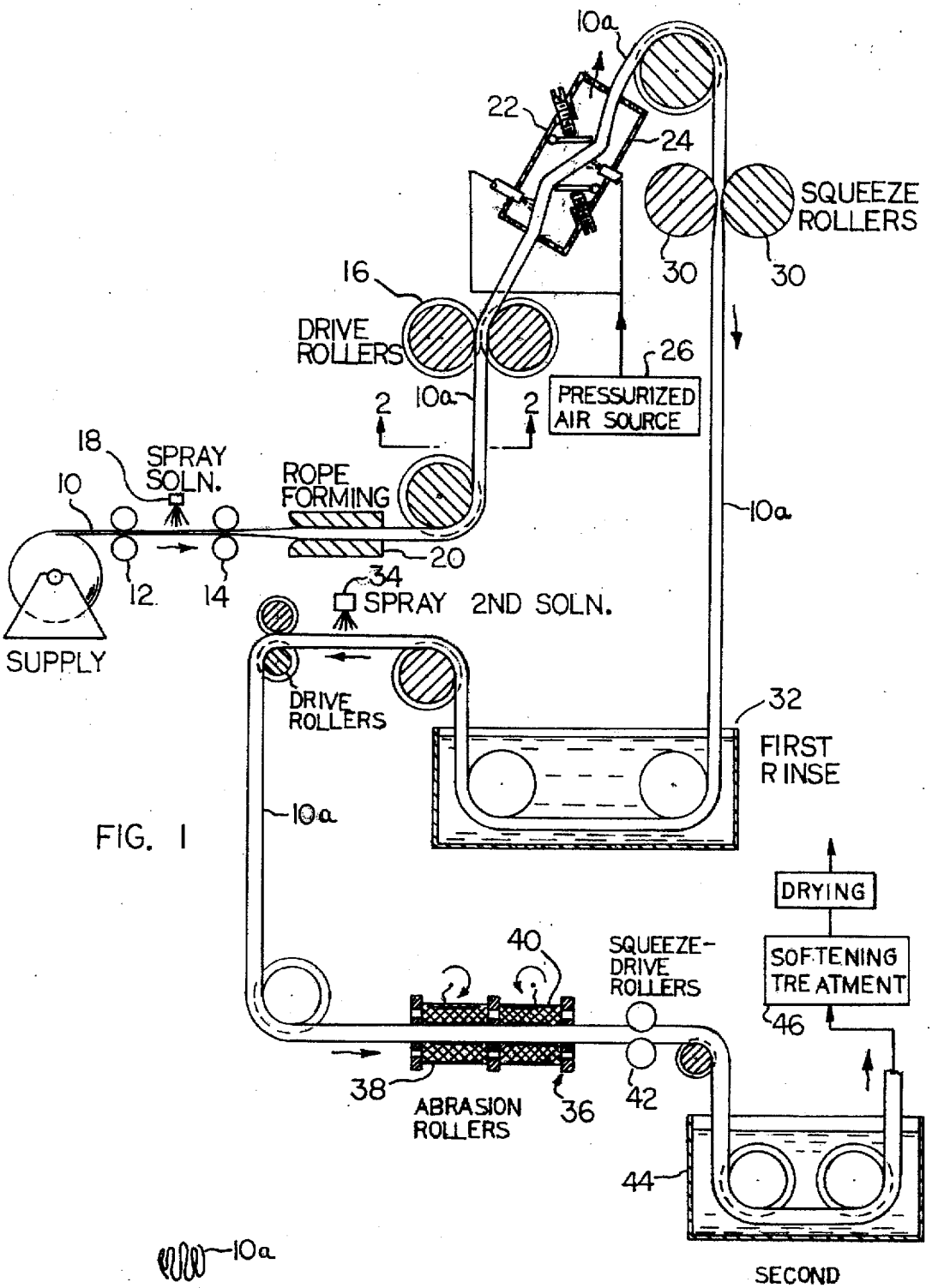
FIG. 1 shows schematically an apparatus that can be used to practice the method of the present invention.
FIG. 2 is a fragmentary sectional view taken on line 2—2 in FIG. 1.

Referring to the drawings, there is shown an apparatus for treating a sheet 10 of indigo blue denim fabric, whereby some of the coloring and sizing agents are removed from the fabric. The treated fabric has a worn-out, stone-washed appearance, and a relatively soft feel to the touch.

As shown, sheet 10 is passed through two sets of guide rolls 12 and 14 under the pulling impetus of drive rollers 16. As it passes from rolls 12 to rolls 14 the fabric sheet is coated with a first water solution containing a non-ionic lubricant, a non-ionic surfactant, and an antimigrant. The term "antimigrant" refers to a fixing agent that prevents colors and dyes from migrating from the outside (upper) surface of the sheet to the inside (lower) surface of the sheet.

The water solution may be sprayed onto the upper surface of the fabric sheet by means of a series of overhead spray nozzles 18 arranged to spray the solution downwardly onto the travelling fabric.

The non-ionic lubricant in the treating solution can be a commercial product supplied by LA Supply of Santa Fe Springs, under the tradename SUNLUBE. The non-ionic surfactant can be a commercial product available from Paradise Textile Product of Chino, Calif. 91710-5724 under the tradename Parascour T-300. The antimigrant in the treating solution can be a commercial product available from LA Supply Inc. under the name White MO. Ammonium acetate, acetic acid and soda ash can be added to the solution as buffers to adjust the pH of the solution to about 0.35% to 2.1%.

The solution supplied to nozzles 18 is preferably heated to a temperature in the range from about ninety degrees to about one hundred fifty degrees Farenheit. Preferably the temperature is near the upper end of the range.

In the water solution the concentration of the lubricant is preferably about five percent by weight, the concentration of the surfactant is preferably about four percent by weight, and the concentration of the antimigrant is preferably about one percent by weight. Depending on the fabric being treated and the color change desired, the concentrations of the active ingredients can be varied within limits. The concentration of the antimigrant can vary from about one half percent to about four percent; the concentration of the surfactant can vary from about one percent to about eight percent; the concentration of the lubricant can vary from about two percent to about nine percent.

The solution-coated fabric sheet 10 is passed through a rope-forming mechanism 20 that transforms the flat sheet into a multi-folded rope-like cross section. FIG. 2 shows the general cross section of the fabric rope 10*a* generated by mechanism 20. The mechanism resembles an extrusion nozzle having a wide entrance mouth that transitions into a generally circular cylindrical exit opening. The fabric has multiple longitudinal folds therein, due to the tension existing between rolls 14 and the entrance mouth of mechanism. The exit mouth of the mechanism gives the fabric its rope configuration. The purpose in forming the fabric sheet into a rope configuration is to bring the fibers together so that the treating solutions are better retained on the fibers.

Fabric rope 10*a* is passed through an impact mechanism 22, whereby impaction forces on the fabric augment the chemical action of the liquid solution supplied by nozzles 18. The impact mechanism can take various forms. As shown in the drawing, the mechanism comprises a tunnel 24 adapted to be supplied with a jet of air from pressurized air source 26; the pressurized air propels the fabric against the surface of flaps with variable angle compatability to exert a deflecting force on the fabric rope.

After passage through the impact mechanism, the fabric rope 10*a* is moved downwardly between two powered squeeze rollers 30 into a rinse tank 32. This action removes particulates and solution from the fabric pores. The fabric rope emerging from rinse tank 32 has a substantial portion of the coloring dyes and sizing agent removed from the fabric. However, the fabric rope is subjected to a further treatment to fully complete the decolorization, de-sizing process.

A second water solution is sprayed onto the fabric rope via a second set of spray nozzles 34. This second water solution comprises an antimigrant having a concentration of about one half percent by weight, a lubricant having a concentration of about one percent by weight, a surfactant having a concentration of about one quarter percent by weight, and a cellulase enzyme having a concentration of about one half percent by weight. The antimigrant, lubricant and surfactant can be the previously described commercial products. The cellulase enzyme can be a commercial product available from LA Supply Inc. of Santa Fe Springs, Calif. 90670 under the tradename Neolase PBBT.

The solution supplied to nozzles 34 is preferably preheated to a temperature in the range of about one hundred fifty to about one hundred eighty degrees Fahrenheit. Buffers are added to the solution to achieve a pH value from about four to about six.

The solution-coated rope is passed through an abrasion mechanism 36 that can take various forms. As shown in the drawing, the mechanism comprises two sets of powered rollers 38 and 40 encircling the travelling rope 10*a*, whereby the roughened surfaces of the rollers exert abraiding forces on the surface of the fabric. The rollers operate in opposite directions, such that the fabric rope maintains an essentially zero twist as it emerges from the abrasion mechanism. The abraiding forces enhance or augment the cleaning action of the solution supplied to the fabric by spray nozzles 34.

The second spray solution (nozzles 34) is preferably more dilute than the first spray solution (nozzles 18), since the second fabric treatment is required to produce a lesser change in the texture and appearance of the fabric. A major portion of the color change and texture change is produced by the first water solution and impact mechanism 22.

The treated fabric rope 10*a* passes from mechanism 36 through a second set of squeeze rollers 42 and second rinse tank 44. Thereafter, the rope is subjected to a fabric softening treatment in a treatment apparatus 46.

Treatment apparatus 46 can comprise a series of spray nozzles arranged to spray the travelling rope with a dilute water solution of a softener having a concentration of about one fourth percent. The softener can be a commercial product available from Piedmont Chemicals Inc. of High Point, N.C. 27261 under the name Pomosoft AC-101 or a commercial product available from Sidney Spring Inc. of Los Angeles, Calif. 90013 under the name Synosoft ULK. The softener solution is preferably pre-heated to a temperature ranging from about ninety degrees to about one hundred fifty degrees Farenheit. After passage through treatment apparatus 46, the fabric rope is preferably rinsed and dried, so that the treated-softened fabric can be used in the manufacture of denim garments.

What is claimed is:

1. A method of removing coloring and sizing agents from indigo blue denim fabric comprising;

(a) coating a travelling sheet of indigo blue denim fabric with a first water solution containing a non-ionic lubricant, a non-ionic surfactant, and an antimigrant;

(b) forming the coated sheet into a travelling folded rope configuration;

(c) passing the rope-formed sheet across an impact mechanism, whereby impaction forces augment the action of the first water solution on the fabric;

(d) rinsing the rope-formed sheet a first time to dilute the first water solution and remove any suspended particles from the fabric;

(e) coating the rope-formed sheet with a second water solution containing an antimigrant; a non-ionic lubricant, a non-ionic surfactant, and a cellulase enzyme;

(f) passing the coated rope-formed sheet from (e) through an abrasion mechanism, whereby abrasion forces augment the cleaning action of the second water solution on the fabric;

(g) rinsing the rope-formed sheet a second time to remove any suspended particles from the fabric; and (h) subjecting the rope-formed sheet to a softening process.

2. The method of claim 1, wherein the first water solution has a lubricant concentration of about five percent by weight, a surfactant concentration of about four percent by weight and an antimigrant concentration of about one percent by weight.

3. The method of claim 1, wherein the first water solution is in a temperature range of about ninety degrees Farenheit to about one hundred fifty degrees Farenheit.

4. The method of claim 1, wherein the second water solution has an antimigrant concentration of about one percent by weight, a surfactant concentration of about one quarter percent by weight, and a cellulase enzyme concentration of about one half percent by weight.

5. The method of claim 1, wherein the second water solution is in a temperature range of about one hundred fifty degrees Farenheit to about one hundred eighty degrees Farenheit.

* * * * *